US011845474B2

(12) United States Patent
Adam et al.

(10) Patent No.: US 11,845,474 B2
(45) Date of Patent: Dec. 19, 2023

(54) ARRANGEMENT FOR A RAIL VEHICLE

(71) Applicant: Siemens Mobility GmbH, Munich (DE)

(72) Inventors: Christoph Adam, Nuremberg (DE); Peter Seitz, Pommelsbrunn (DE)

(73) Assignee: Siemens Mobility GmbH, Munich (DE)

( * ) Notice: Subject to any disclaimer, the term of this patent is extended or adjusted under 35 U.S.C. 154(b) by 0 days.

(21) Appl. No.: 18/013,027

(22) PCT Filed: Aug. 6, 2021

(86) PCT No.: PCT/EP2021/072076
§ 371 (c)(1),
(2) Date: Dec. 27, 2022

(87) PCT Pub. No.: WO2022/033989
PCT Pub. Date: Feb. 17, 2022

(65) Prior Publication Data

US 2023/0211812 A1 Jul. 6, 2023

(30) Foreign Application Priority Data

Aug. 12, 2020 (DE) ..... 10 2020 210 211.2

(51) Int. Cl.
*B61C 3/00* (2006.01)
*B61C 9/44* (2006.01)

(52) U.S. Cl.
CPC . *B61C 3/00* (2013.01); *B61C 9/44* (2013.01)

(58) Field of Classification Search
CPC ..... B61C 3/00; B61C 9/44; B61C 9/50
See application file for complete search history.

(56) References Cited

U.S. PATENT DOCUMENTS

| | | | |
|---|---|---|---|
| 2015/0054367 A1 | 2/2015 | Eriksson et al. | |
| 2019/0036418 A1 | 1/2019 | Adam et al. | |
| 2021/0367466 A1 | 11/2021 | Oude Kotte et al. | |

FOREIGN PATENT DOCUMENTS

| | | | | |
|---|---|---|---|---|
| CN | 107776587 A | 3/2018 | | |
| CN | 108099926 A | 6/2018 | | |
| DE | 1107692 B | 5/1961 | | |
| DE | 102018216490 A1 | 3/2020 | | |
| EP | 0137931 A2 * | 4/1985 | ..... | B61C 9/44 |
| EP | 3185403 A1 | 6/2017 | | |
| EP | 3470288 A1 | 4/2019 | | |
| WO | WO 2019072499 A1 | 4/2019 | | |

* cited by examiner

*Primary Examiner* — Robert J McCarry, Jr.
(74) *Attorney, Agent, or Firm* — Laurence A. Greenberg; Werner H. Stemer; Ralph E. Locher

(57) ABSTRACT

An arrangement for a rail vehicle has an electric hollow-shaft motor with a hollow rotor and a wheelset shaft that runs through the hollow rotor. The rotor is separated from the wheelset shaft at least in certain sections by a radial air gap which ensures a mechanical clearance between the wheelset shaft and the rotor. A protective material is arranged in the region of the radial air gap between the rotor and the wheelset shaft. The protective material, in the event of failure of a motor fastening of the hollow-shaft motor and subsequent support of the rotor on the wheelset shaft, separates the rotor from the wheelset shaft. The protective material is softer than the material of the wheelset shaft and softer than at least one material of the rotor.

18 Claims, 5 Drawing Sheets

ARRANGEMENT FOR A RAIL VEHICLE

FIELD AND BACKGROUND OF THE INVENTION

The invention relates to an arrangement for a rail vehicle, a hollow-shaft motor with a corresponding arrangement and a rail vehicle.

Hollow-shaft motors can be employed for example in rail vehicles as drive motors. These can be employed as what is known as a direct drive, in which a wheelset shaft extends through the rotor of the hollow-shaft motor and the wheelset shaft is driven directly by the rotor. The hollow-shaft motor is held radially spaced apart from the wheelset shaft by means of a motor fastening.

SUMMARY OF THE INVENTION

The object of the invention is to specify an arrangement in which, in the event of a failure of the motor fastening of the hollow-shaft motor, damage to the motor and the risk of accidents and in particular danger to persons is reduced.

This object is inventively achieved by an arrangement having the features as claimed. Advantageous embodiments of the inventive arrangement are specified in dependent claims.

Accordingly it is inventively provided that arranged in the region of the radial air gap between the rotor and the wheelset shaft is a protective material which in the event of a failure of the motor fastening of the hollow-shaft motor and subsequent support of the rotor on the wheelset shaft separates the rotor from the wheelset shaft, wherein the protective material is softer than the material of the wheelset shaft and softer than at least one material of the rotor.

A significant advantage of the inventive arrangement can be seen in that in the event of any failure of the motor fastening the rotor of the hollow-shaft motor cannot fall directly onto the wheelset shaft guided therein, since the inventively provided soft protective material keeps shaft and rotor separate.

According to one development the protective material forms at least one protective ring, which is arranged on the interior of the hollow rotor and has a smaller internal diameter than the rotor, wherein in the event of a failure of the motor fastening the at least one protective ring rests on the wheelset shaft, or is arranged on the exterior of the wheelset shaft, has a larger external diameter than the wheelset shaft and in the event of a failure of the motor fastening supports the rotor.

According to an alternative development to the aforementioned development, the protective material forms at least one protective tube, which is arranged on the interior of the hollow rotor and has a smaller internal diameter than the rotor, wherein in the event of a failure of the motor fastening the at least one protective tube rests on the wheelset shaft, or is arranged on the exterior of the wheelset shaft, has a larger external diameter than the wheelset shaft and in the event of a failure of the motor fastening supports the rotor.

According to a further alternative development, the protective material forms at least two protective rings, which are each arranged on the interior of the hollow rotor, have a smaller internal diameter than the rotor and are spaced apart axially from one another, wherein one of the protective rings is arranged in the region of one axial end of the rotor and the other protective ring is arranged in the region of the other axial end of the rotor.

In accordance with a further development the two axially spaced-apart protective rings are made of materials of different hardness.

In accordance with a further development a radially interior rotor tube is arranged between the two axially spaced-apart protective rings and is axially fixed by at least one of the protective rings. An interior rotor tube such as this can for example advantageously protect hollow spaces in the rotor from the wheelset shaft.

In accordance with a further development the rotor comprises ferrous laminated cores and the protective material is softer than the material of the ferrous laminated cores.

In accordance with a further development the at least one protective ring and/or the at least one protective tube is mounted as a separate part on the interior face of the rotor or on the exterior face of the wheelset shaft or is attached by a coating process.

According to a further development the protective material is non-ferrous.

In accordance with a further development the protective material contains aluminum and/or copper or consists thereof. Alternatively or additionally the protective material contains rubber, for example specifically acrylonitrile-butadiene rubber, and/or natural rubber or consists thereof. Alternatively or additionally the protective material has a maximum elastic limit of 200 $N/mm^2$.

In accordance with a further development the hollow-shaft motor is held by a chassis or frame of a vehicle and the wheelset shaft is rotatably mounted by means of bearings attached to the chassis or the frame.

In accordance with a further development the rotor is non-rotatably connected to the wheelset shaft at one of its two rotor ends by means of an axially and/or radially movable connection device, wherein the connection device enables an axial and/or radial relative movement between the rotor end and the wheelset shaft.

In accordance with a further development a protective ring close to the connection device is softer than a protective ring remote from the connection device. A different hardness such as this of the protective material is possible since a mechanical load of the close protective ring is smaller in the event of a failure of the motor fastening than that of the remote protective ring.

In accordance with a further alternative development it is provided that the protective material forms at least two protective rings, which in each case are arranged on the exterior of the wheelset shaft, have a larger external diameter than the wheelset shaft and are axially spaced apart from one another, wherein one of the protective rings is attached to the wheelset shaft in the region of one axial end of the rotor and the other protective ring is attached in the region of the other axial end of the rotor.

The object is further achieved by a hollow-shaft motor which has an inventive arrangement.

Finally the object is achieved by a rail vehicle having at least one inventive arrangement or at least one inventive hollow-shaft motor.

The rail vehicle can here for example be a rail vehicle externally supplied with electric power via a current collector, a battery-driven rail vehicle, a rail vehicle fitted with fuel cells or a hybrid rail vehicle.

BRIEF DESCRIPTION OF THE FIGURES

The invention is explained in greater detail below using exemplary embodiments, where for example.

DETAILED DESCRIPTION OF THE INVENTION

Figure 1:
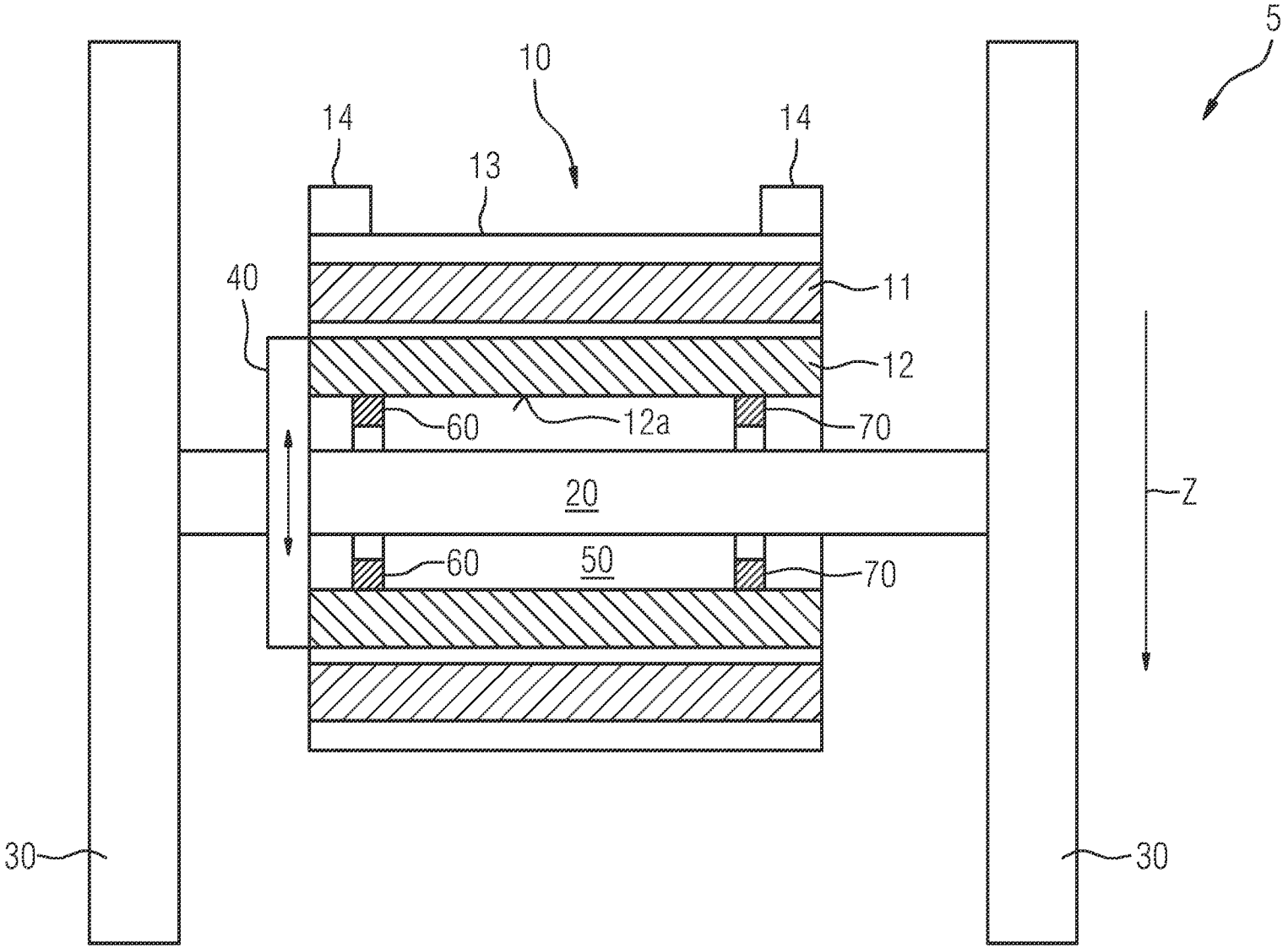
FIG. 1 shows an exemplary embodiment of an inventive arrangement which forms part of a vehicle, not further shown, in particular a rail vehicle, wherein a hollow-shaft motor is held in its normal position by a motor fastening.

For the sake of clarity the same reference characters are always used in the figures for identical or comparable components.

FIG. 1 shows an exemplary embodiment of an inventive arrangement 5, which forms part of a vehicle, not further shown, in particular a rail vehicle. The arrangement 5 comprises a hollow-shaft motor 10 which has an external stator 11 and an interior, hollow rotor 12.

The rotor 12 comprises ferrous laminated cores, which during the operation of the hollow-shaft motor 10 are penetrated by magnet fields generated by the stator 11.

The stator 11 is held by a housing 13 of the hollow-shaft motor 10, which in turn is held by a motor fastening 14, merely indicated, on a chassis or frame of the vehicle, not further shown.

Extending through the internal hollow rotor 12 is a wheelset shaft 20, attached to the shaft ends of which in each case is a vehicle wheel 30 of the vehicle. The wheelset shaft 20 is rotatably mounted on the chassis or frame of the vehicle by means of bearings, which for reasons of clarity are likewise not shown in FIG. 1.

The rotor 12 is non-rotatably connected to the wheelset shaft 20 by means of a connection device 40 which is preferably axially and radially movable and enables a certain axial and radial relative movement between the rotor 12 and the wheelset shaft 20, for example to be able to absorb vibrations of the wheelset shaft 20 during the journey.

Thanks to the motor fastening 14 the hollow-shaft motor 10 and thus also the rotor 12 is kept separate from the wheelset shaft 20 by the formation of a radial air gap 50. Located in the air gap 50 in the exemplary embodiment in accordance with FIG. 1 are two protective rings 60 and 70, which are attached to the interior 12*a* of the hollow rotor 12 and have a smaller internal diameter than the rotor 12. The function of the protective rings 60 and 70 is to form a protective material which in the event of a failure of the motor fastening 14 keeps the rotor 12 separate from the wheelset shaft 20. If a failure of the motor fastening 14 does occur, the hollow-shaft motor 10 will fall down along the direction of the arrow Z. The protective rings 60 and 70 in this case prevent the rotor 12 from striking the wheelset shaft 20 and damaging it. With a view to the claimed protective effect, the protective rings 60 and 70 consist of a material that is softer than the material of the wheelset shaft 20, which is preferably made of steel, and softer than the material of the ferrous laminated cores of the rotor 12.

Figure 2:
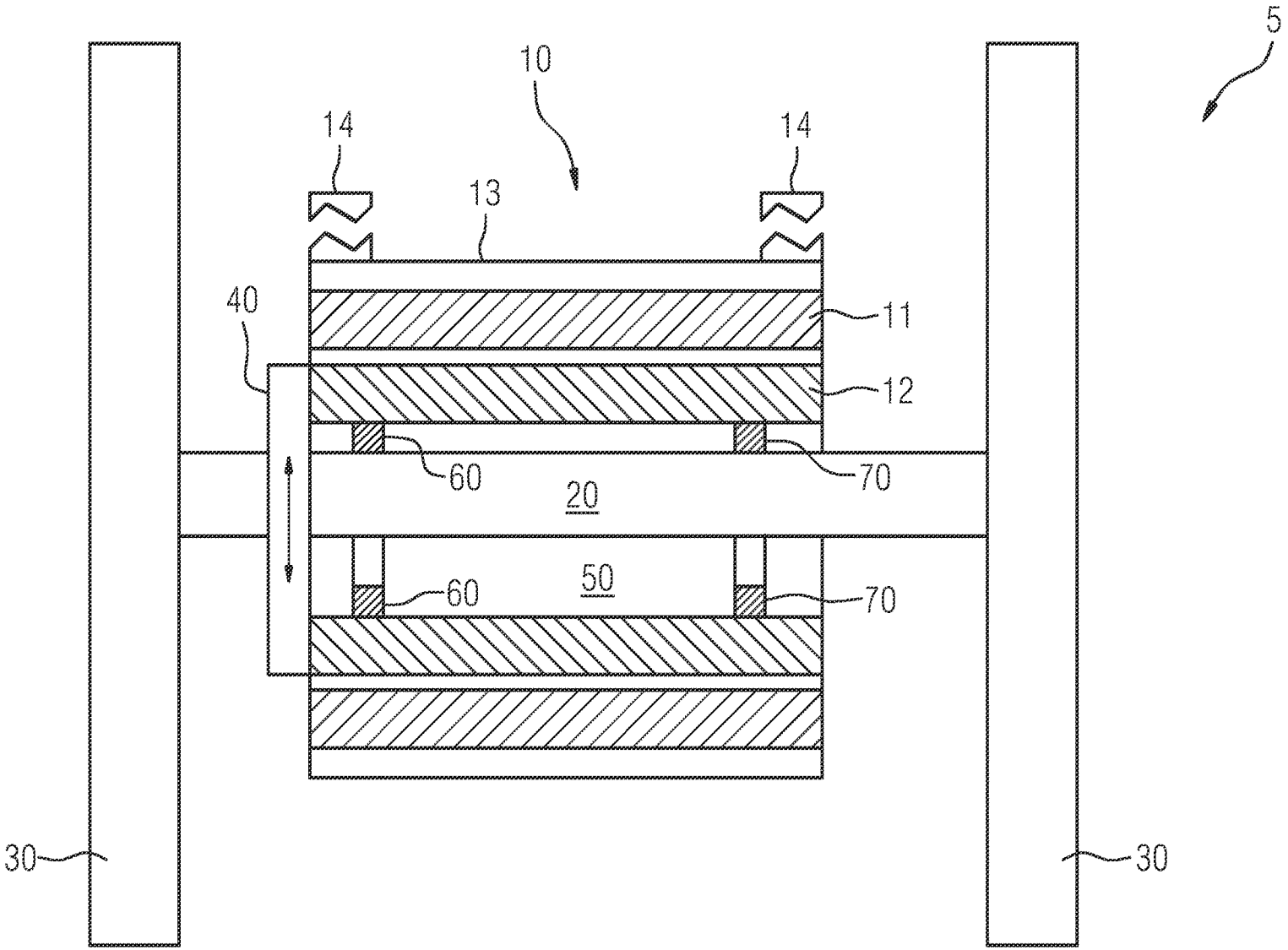
FIG. 2 shows the arrangement in accordance with FIG. 1 in the event of a failure of the motor fastening and of the hollow-shaft motor falling down onto a wheelset shaft guided therein.

FIG. 2 shows the arrangement 5 in accordance with FIG. 1 following a failure of the motor fastening 14. It can be seen that the hollow-shaft motor 10 has dropped and the protective rings 60 and 70 are supported on the wheelset shaft 20. Thanks to the protective rings 60 and 70 the rotor 12 remains separate from the wheelset shaft 20, so that it cannot damage it.

The two protective rings 60 and 70 preferably consist of aluminum, copper, rubber or natural rubber. It is particularly advantageous if the protective ring 60 close to the connection device 40 consists of a softer material than the protective ring remote from the connection device 40.

Figure 3:
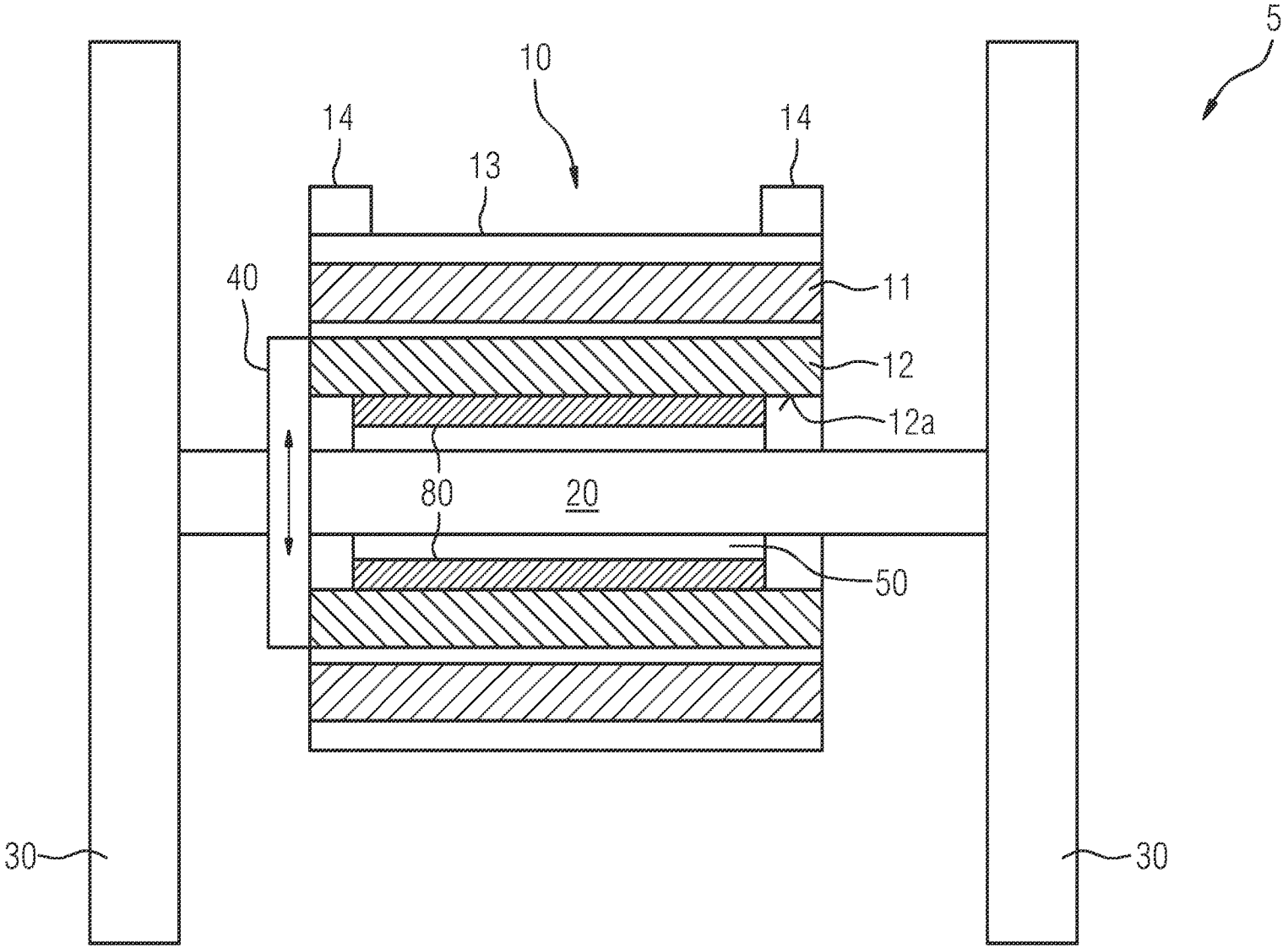
FIG. 3 shows an exemplary embodiment of an inventive arrangement, in which protective material forms an internal protective tube.

FIG. 3 shows a further exemplary embodiment of an arrangement, in which a protective material is arranged between the rotor 12 and the wheelset shaft 20. In the exemplary embodiment in accordance with FIG. 3 the protective material forms a protective tube 80, which abuts the interior 12*a* of the rotor 12 and is permanently connected to the rotor 12. The protective tube 80 can be a separate part which is inserted into the rotor 12; alternatively the protective tube 80 can also, in the context of a coating process, be attached to the interior 12*a* of the rotor 12, for example by cold gas spraying.

In the event of a failure of the motor fastening 14, the protective tube 80 separates the rotor 12 from the wheelset shaft 20, as was explained above in connection with the protective rings 60 and 70 in the exemplary embodiment in accordance with FIGS. 1 and 2.

Figure 4:
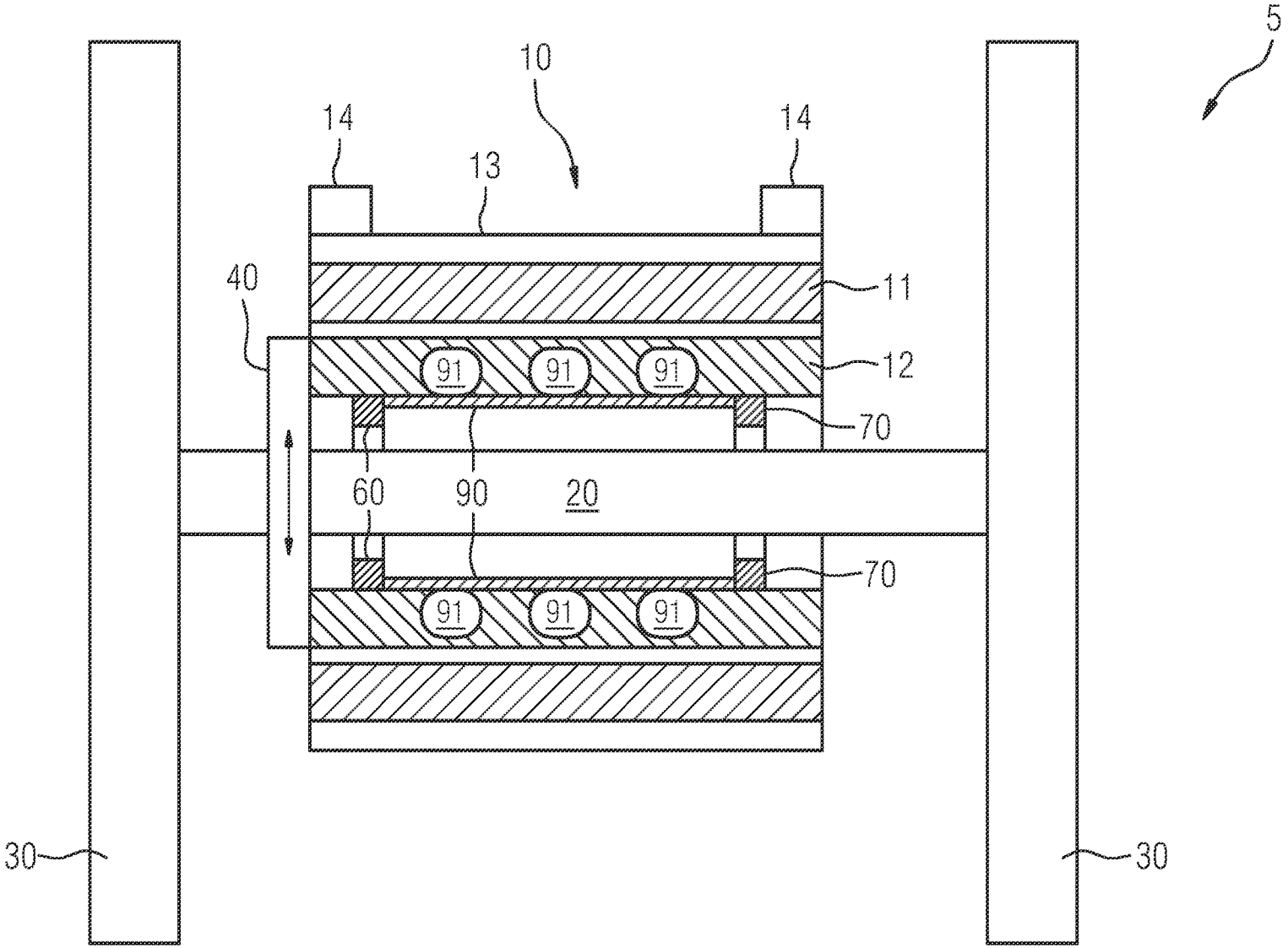
FIG. 4 shows an exemplary embodiment of an inventive arrangement, in which a radially interior rotor tube is arranged between two axially spaced-apart protective rings.

FIG. 4 shows a third exemplary embodiment of an inventive arrangement, in which protective material is present between rotor 12 and wheelset shaft 20. In the exemplary embodiment in accordance with FIG. 4 the two protective rings 60 and 70 play a dual function. Firstly, as explained in connection with FIGS. 1 and 2, in the event of a failure of the motor fastening 14, they serve to keep the rotor 12 separate from the wheelset shaft 20; secondly they serve to axially fix a radially interior rotor tube 90 which separates hollow spaces 91 inside the rotor 12 from the wheelset shaft 20. Hollow spaces 91 inside the rotor 12 can advantageously be provided in order, with a view to a high torque of the hollow-shaft motor 10, to achieve a large rotor diameter with as low an overall weight as possible.

Figure 5:
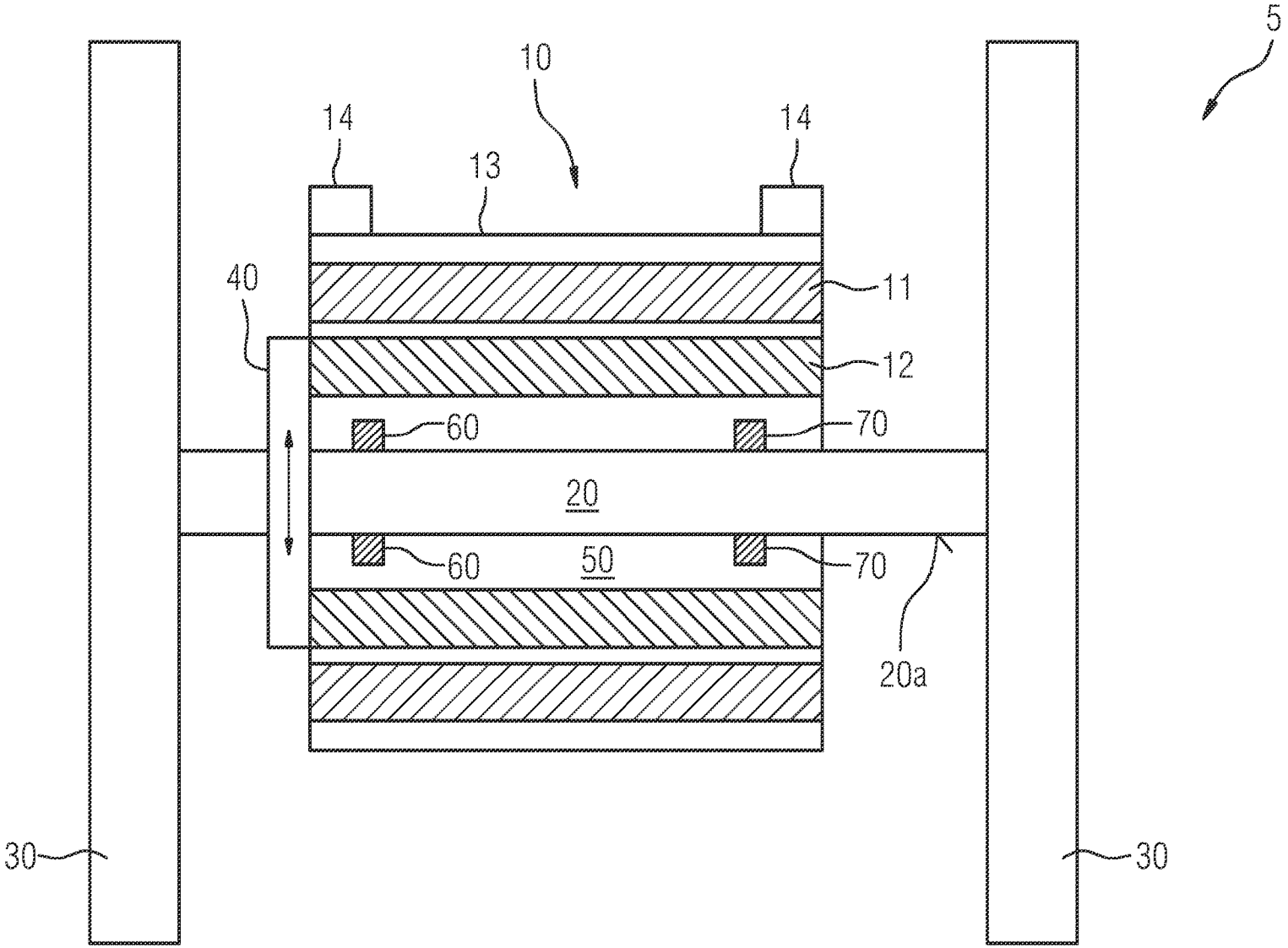
FIG. 5 shows an exemplary embodiment of an inventive arrangement, in which protective rings are arranged on the wheelset shaft.

FIG. 5 shows a fourth exemplary embodiment of an inventive arrangement, in which protective material is provided between wheelset shaft 20 and rotor 12. Unlike the exemplary embodiments in accordance with FIGS. 1 to 4, in the arrangement in accordance with FIG. 5 the protective material is provided on the wheelset shaft 20, in the form of two protective rings 60 and 70 that are mounted on the exterior 20*a* of the wheelset shaft 20. The explanations above in connection with FIGS. 1 and 2 apply accordingly in respect of the protective effect of the protective rings 60 and 70.

LIST OF REFERENCE CHARACTERS

5 Arrangement
10 Hollow-shaft motor
11 Stator
12 Rotor
12*a* Interior
13 Housing
14 Motor fastening
20 Wheelset shaft
20*a* Exterior

30 Vehicle wheel
40 Connection device
50 Air gap
60 Protective ring
70 Protective ring
80 Protective tube
90 Rotor tube
91 Hollow space
Z Direction of arrow

The invention claimed is:

1. An arrangement for a rail vehicle, comprising:
an electric hollow-shaft motor having a hollow rotor;
a wheelset shaft extending coaxially through said hollow rotor, said rotor being separated from said wheelset shaft at least in part by a radial air gap formed to ensure a mechanical play between said wheelset shaft and said rotor;
protective material disposed in said radial air gap between said rotor and said wheelset shaft and configured, in an event of a failure of a motor fastening of said hollow-shaft motor and a subsequent support of said rotor on said wheelset shaft, to separate said rotor from said wheelset shaft, said protective material being softer than a material of said wheelset shaft and softer than at least one material of the rotor.

2. The arrangement according to claim 1, wherein said protective material forms at least one protective ring, and
said at least one protective ring is disposed on an interior of said hollow rotor and has a smaller internal diameter than said rotor, wherein said at least one protective ring rests on said wheelset shaft in the event of a failure of the motor fastening; or
said at least one protective ring is disposed on an exterior of said wheelset shaft, has a larger external diameter than said wheelset shaft, and in the event of a failure of the motor fastening supports said rotor.

3. The arrangement according to claim 2, wherein said at least one protective ring is mounted as a separate part on an interior face of said rotor or on an exterior face of said wheelset shaft or is formed by a coating process.

4. The arrangement according to claim 1, wherein said protective material forms at least one protective tube, and
said at least one protective tube is disposed on an interior of said hollow rotor and has a smaller internal diameter than said rotor, wherein said at least one protective tube rests on said wheelset shaft in the event of a failure of the motor fastening; or
said at least one protective tube is disposed on an exterior of said wheelset shaft, has a larger external diameter than said wheelset shaft, and in the event of a failure of the motor fastening supports said rotor.

5. The arrangement according to claim 4, wherein said protective tube is mounted as a separate part on an interior face of said rotor or on an exterior face of said wheelset shaft or is formed by a coating process.

6. The arrangement according to claim 1, wherein:
said protective material forms at least two protective rings, each being disposed on an interior of said hollow rotor and having a smaller internal diameter than an internal diameter of said rotor, and said at least two protective rings being axially spaced apart from one another; and
one of said at least two protective rings being arranged in a region of one axial end of said rotor and another one of said at least two protective rings being arranged in a region of an opposite axial end of said rotor.

7. The arrangement according to claim 6, wherein said axially spaced-apart protective rings consist of materials of different hardness.

8. The arrangement according to claim 6, further comprising a radially interior rotor tube disposed between said axially spaced-apart protective rings and axially fixed by at least one of said protective rings.

9. The arrangement according to claim 1, wherein said rotor comprises ferrous laminated cores, and said protective material is softer than a material of said ferrous laminated cores.

10. The arrangement according to claim 1, wherein said protective material is a non-ferrous material.

11. The arrangement according to claim 1, wherein at least one of the following is true:
said protective material contains, or consists of, at least one of aluminum or copper;
said protective material contains, or consists of, rubber or natural rubber;
said protective material has a maximum elastic limit of 200 $N/mm^2$.

12. The arrangement according to claim 1, wherein:
said hollow-shaft motor is mounted to a chassis or a frame of a vehicle; and
said wheelset shaft is rotatably mounted by way of bearings attached to the chassis or the frame of the vehicle.

13. The arrangement according to claim 1, further comprising:
a connection device disposed to non-rotatably connect said rotor to said wheelset shaft at one of two rotor ends;
said connection device being at least one of axially or radially movable; and
said connection device enabling at least one of an axial or radial movement between the said rotor end and said wheelset shaft.

14. The arrangement according to claim 13, wherein:
said protective material forms at least two protective rings that are axially spaced apart from one another; and
said protective ring close to said connection device being softer than said protective ring remote from said connection device.

15. The arrangement according to claim 1, wherein:
said protective material forms at least two protective rings, each arranged on an exterior of said wheelset shaft, having a larger external diameter than said wheelset shaft and being axially spaced apart from one another; and
one of said protective rings is attached to said wheelset shaft in a region of one axial end of said rotor and another protective ring is attached in a region of another axial end of said rotor.

16. A hollow-shaft motor for a rail vehicle, comprising an arrangement according to claim 1.

17. A rail vehicle, comprising at least one arrangement according to claim 1.

18. A rail vehicle, comprising at least one hollow-shaft motor with an arrangement according to claim 1.

* * * * *